US008360564B2

(12) United States Patent
Stamp

(10) Patent No.: US 8,360,564 B2
(45) Date of Patent: Jan. 29, 2013

(54) DUAL CONDENSOR

(75) Inventor: Michael Jeffrey Stamp, Leicester (GB)

(73) Assignee: Videojet Technologies Inc.

( * ) Notice: Subject to any disclaimer, the term of this patent is extended or adjusted under 35 U.S.C. 154(b) by 418 days.

(21) Appl. No.: 12/744,394

(22) PCT Filed: Nov. 21, 2008

(86) PCT No.: PCT/US2008/084379

§ 371 (c)(1),
(2), (4) Date: May 24, 2010

(87) PCT Pub. No.: WO2009/073413

PCT Pub. Date: Jun. 11, 2009

(65) Prior Publication Data

US 2010/0259588 A1 Oct. 14, 2010

(30) Foreign Application Priority Data

Nov. 29, 2007 (GB) ..... 0723475.0

(51) Int. Cl.
*B41J 2/175* (2006.01)

(52) U.S. Cl. ..... 347/85

(58) Field of Classification Search ..... 347/6, 7, 347/84, 85, 89
See application file for complete search history.

(56) References Cited

U.S. PATENT DOCUMENTS

| | | | |
|---|---|---|---|
| 5,226,285 | A | 7/1993 | Dankowski |
| 6,352,324 | B1 | 3/2002 | Pagnon |
| 6,450,601 | B1 | 9/2002 | Pagnon |

FOREIGN PATENT DOCUMENTS

| | | | |
|---|---|---|---|
| JP | 409300653 | * | 11/1997 |
| WO | WO2010019855 | * | 2/2010 |

* cited by examiner

*Primary Examiner* — Kristal Feggins
(74) *Attorney, Agent, or Firm* — Joseph A. Yosick

(57) ABSTRACT

The present invention relates to ink jet printing. More particularly, the invention relates to a condenser assembly for an ink jet printer. The condenser assembly comprises a first condenser adapted to separate first solvent vapor from a first fluid by condensation of said first solvent onto a first coolable surface and a second condenser adapted to separate second solvent vapor from a second fluid by condensation of said second solvent onto a second coolable surface.

20 Claims, 3 Drawing Sheets

DUAL CONDENSOR

RELATED APPLICATIONS

Figure 1:
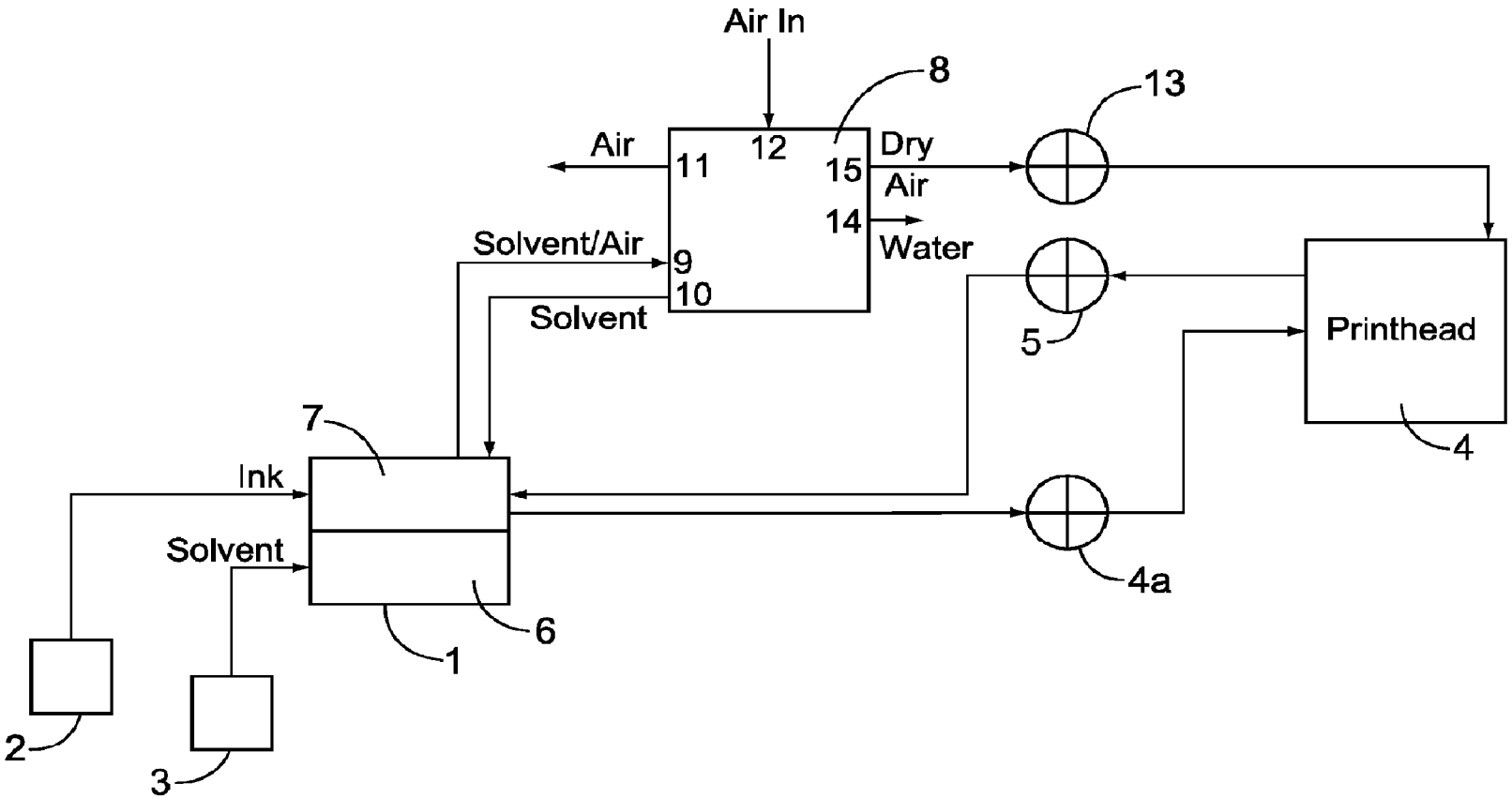

This application claims priority under 35 U.S.C. §371 from PCT Application No. PCT/US2008/084379, filed in English on Nov. 21, 2008, which claims the benefit of: Great Britain Application Serial No. 0723475.0 filed on Nov. 29, 2007, the disclosures of which are incorporated by reference herein in their entireties.

The present invention relates to ink jet printing and more particularly to a condenser for use in an ink jet printer such as a continuous ink jet printer.

In ink jet printing systems the print is made up of individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurised ink to a print head assembly, having a drop generator where a continuous stream of ink emanating from a nozzle is broken up into individual, regular drops by an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. A phase measurement system is also usually present as part of deflection plate assembly and is used to ensure synchronisation of deflection for the droplets. The charged drops bypass the gutter and hit the substrate at a position determined by the charge on the drop and the position of the substrate relative to the print head assembly. Typically the substrate is moved relative to the print head assembly in one direction and the drops are deflected in a direction generally perpendicular thereto, although the deflection plates may be oriented at an inclination to the perpendicular to compensate for the speed of the substrate (the movement of the substrate relative to the print head assembly between drops arriving means that a line of drops would otherwise not quite extend perpendicularly to the direction of movement of the substrate).

In continuous ink jet printing a character is printed from a matrix comprising a regular array of potential drop positions. Each matrix comprises a plurality of columns (strokes), each being defined by a line comprising a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

The heater in the print head assembly ensures that the viscosity of the ink, which varies with the ink temperature, is maintained at a value such that the drop generator in the print head assembly works effectively. If the ink is too viscous, because its temperature is too low, or too thin, because it is too hot, then the ink stream will not break up into suitable droplets.

Ink is delivered under pressure to the print head assembly from an ink supply system that is generally housed within a sealed compartment of a cabinet that includes a separate compartment for control circuitry and a user interface panel. The system includes a main pump that draws the ink from a reservoir or tank via a filter and delivers it under pressure to the print head assembly. As ink is consumed the reservoir is refilled as necessary from a replaceable ink cartridge that is releasably connected to the reservoir by a supply conduit. The ink is fed from the reservoir via a flexible delivery conduit to the print head assembly. Electrical power to operate the heater in the print head assembly and the drop generator are supplied by power supply system cables, typically forming part of the supply conduit The unused ink drops captured by the gutter are recirculated to the reservoir via a return conduit, typically located as part of the supply conduit, by a pump. The flow of ink in each of the conduits is generally controlled by solenoid valves and/or other like components.

As the ink circulates through the system, there is a tendency for it to thicken as a result of solvent evaporation. This is particularly a problem in relation to the recirculated ink that has been exposed to air in its passage between the nozzle and the gutter. In order to compensate for this "make-up" solvent is added to the ink as required from a replaceable solvent cartridge so as to maintain the ink viscosity within desired limits when the ink is at the correct operating temperature. This solvent may also be used for flushing components of the print head assembly, such as the nozzle and the gutter, in a cleaning cycle.

It will be appreciated that ambient air in the region of the print head, and its gutter, will also normally contain water vapour, in addition to evaporated solvent vapour from the ink, unless special precautions are taken to provide dried air in the vicinity of the print head. When air and ink are sucked from the gutter to the solvent condenser of the printer, water vapour present in the air, may condense in the solvent condenser and consequently be returned to the ink reservoir along with recycled solvent. The solvent is typically non-aqueous, and so the presence of water is undesirable. This contamination of the ink with water can lead to changes in characteristics such as the viscosity of the ink, leading to problems with droplet formation. Hence it is highly desirable to minimize any contamination of the ink by water. Also, any fine dust or particles in the air surrounding the print head and print head gutter may be drawn in with the ink from the gutter for recycling, leading to further potential contamination of the ink supply arising from recycling of ink and solvent from the gutter.

A method used in the prior art is to provide a flow of dry, filtered gas, such as dry compressed air at the print head, provided from a compressed air line located in the work space where the ink jet printer is operating. However, it may be desirable to operate the ink jet printer in a location where no such dry compressed air line is available and in any event, the provision of such dried compressed air often requires the use of expensive equipment.

Hence there is a need for an improved method for reducing contamination of ink by undesirable matter in recycled gutter air for continuous ink jet printers.

It is an object of embodiments of the present invention, amongst others, to provide a condenser for use in an ink jet printer which obviates or mitigates one or more of the problems outlined above.

According to a first aspect of the present invention there is provided a condenser for an ink jet printer comprising: a first condenser adapted to separate first solvent vapour from a first fluid by condensation of said first solvent onto a first coolable surface; and a second condenser adapted to separate second solvent vapour from a second fluid by condensation of said second solvent onto a second coolable surface.

The condenser may further comprise cooling means adapted to cool both the first and the second coolable surfaces. The cooling means used may be any suitable cooling means, such as a refrigerated pipe attached to a conventional adiabatic expansion refrigeration pump, such as used in domestic and industrial refrigeration. However, for compactness, a Peltier cooler is a preferred component of the cooling means.

The condenser may further comprise a first input port arranged to receive said first fluid; first and second output ports respectively arranged to output said first solvent and first fluid from which said first solvent has been condensed; a second input port arranged to receive said second fluid; and third and fourth output ports respectively arranged to output said second solvent and second fluid from which said second solvent has been condensed. The second input port and the third output port may be coincident so as to aid compactness of the condenser.

The condenser may comprise a housing in which a coolable member is received, the coolable member providing said first and second coolable surfaces. The housing may be formed from a plurality of separable parts in order to facilitate a fluid tight mating of the cooling member and the cavity within the housing. For example, the housing may comprise a substantially cylindrical housing wall, and may comprise a housing lid arranged to mate with said substantially cylindrical housing wall.

The condenser may define a first condenser region arranged to condense said first solvent from said first fluid and a second condenser region arranged to condense said second solvent from said second fluid. A sealing member may be located between said first and second condenser regions. The sealing member cam take any suitable form, and may comprise a fluid-tight gasket such as an o-ring seal. The coolable member and the housing may be provided with suitable grooves adapted to fit such gaskets or seals. Similar appropriate sealing arrangements may also be used at the other interfaces between the cooling member and the housing in order to provide fluid-tight seals.

In order to improve the efficiency of the condenser systems, by increasing the surface areas of cooled surfaces in contact with the fluid flows, the first and/or second collection surfaces are suitably ribbed. By ribbed, it is meant that the surfaces are provided with fins or projections to increase their surface areas.

The ribs may be arranged to aid with the collection of the first and/or second liquid solvents from the condensers. For instance, a helical arrangement of ribs may be used to facilitate drainage of a liquid solvent to a drainage port of a condenser whilst allowing fluid to flow readily through the condenser.

The first fluid may comprise air and organic solvent vapour, and the first solvent is said organic solvent. The second fluid may be atmospheric air and the second solvent may be water.

The condenser may be a component of an ink jet printer, such as a continuous ink jet printer. The printer may comprise a print head; and an ink supply system arranged to provide ink to the print head. The ink supply system may comprise an ink tank defining a chamber which is arranged to be partially occupied by a reservoir of liquid ink. The condenser may be arranged to receive said first fluid from a portion of said chamber not occupied by said reservoir of liquid ink. The printer may further comprise a conduit arranged to provide said first solvent to said ink tank, so that it may be re-mixed with the ink to minimise the need for solvent replacement during operation of the printer. The second fluid from which water has been condensed may be directed to said print head, for example, the second fluid from which water has been condensed may be pumped across said print head so as to clean said print head.

Although a separate, pressurised gas supply, such as a gas cylinder or a compressed air line, could be used to supply said second fluid, it is preferred that the second fluid it atmospheric air which may suitably be drawn from the atmospheric air surrounding the ink jet printer, or may be drawn from a region remote from the printer location using a supply tube. A suitable air inlet may be provided in the casing of the main body of the ink jet printer. The air is typically drawn in through the air inlet by a pumping means, such as a positive displacement gas pump, to provide the first gas flow. Such a pump will typically be located in a fluidic circuit supplying the first gas flow to the print head where it is to be used as a purging gas. The pump is preferably located, in the fluidic circuit, between the condenser assembly and the and the print head, such that the first gas flow has already been dried by the water condenser of the condenser assembly when it reaches the pump, minimising water contamination of the pump. The fluidic circuit for the first gas flow is preferably provided with a dust filter to remove particulate matter from the gas flow prior to it being used for purging the print head.

Figure 2:
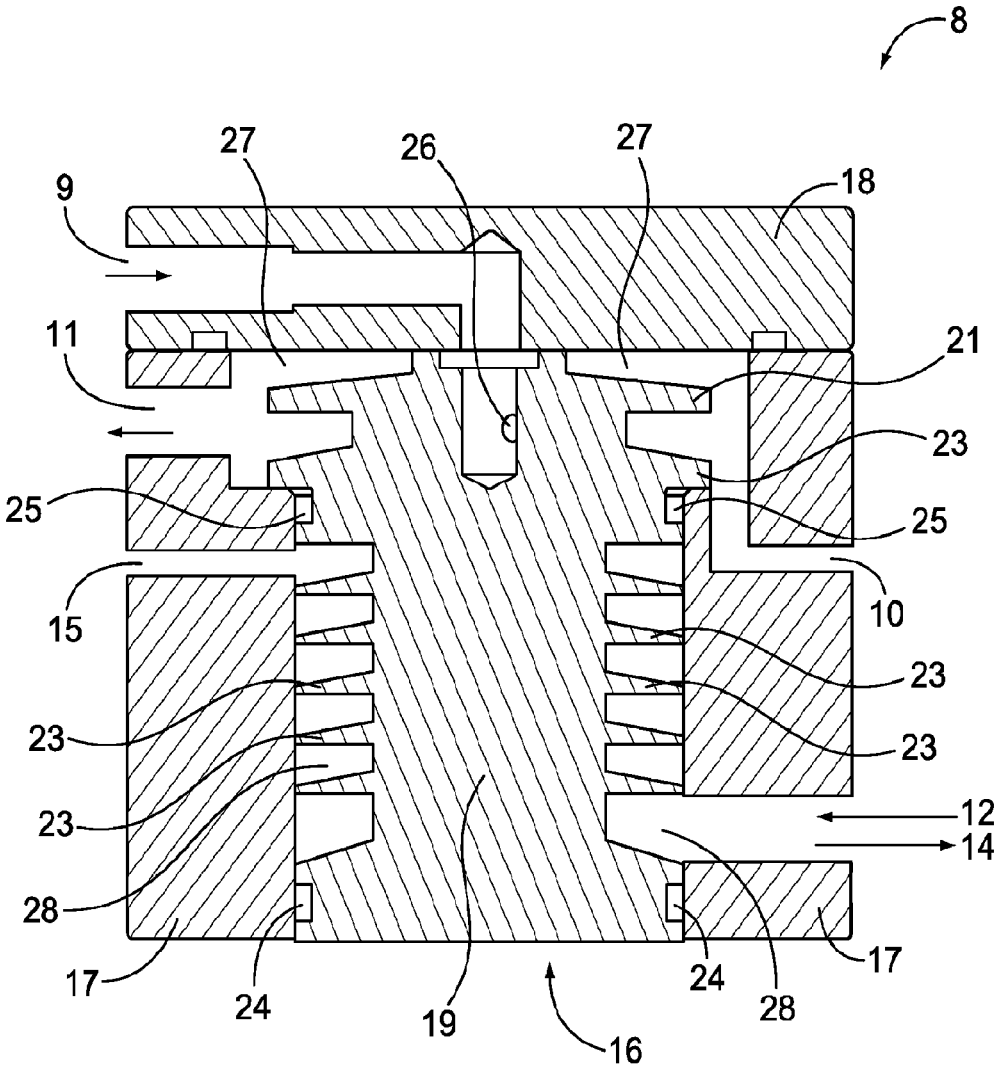
Figure 3:
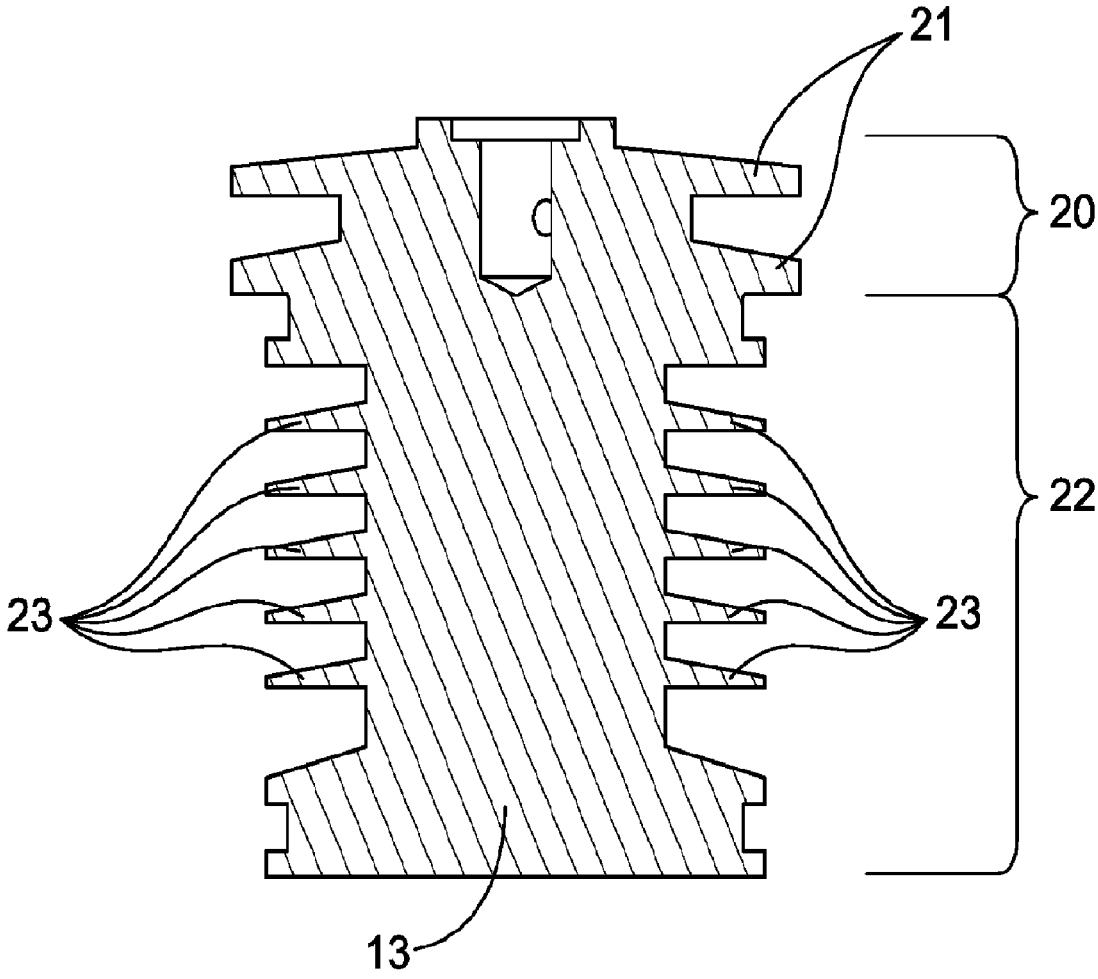

An embodiment of the present invention will now be described, by way of example, with reference to the accompanying drawings, in which:

FIG. 1 is a schematic illustration of a continuous ink jet printer including a condenser in accordance with an embodiment of the invention; and FIG. 2 is a schematic cross-sectional view of a condenser used in the continuous ink jet printer of FIG. 1; and FIG. 3 is a schematic cross-sectional view of a coolable member of the condenser of FIG. 2.

FIG. 1 is a schematic illustration of a continuous ink jet printer. The continuous ink jet printer comprises an ink tank 1 which receives ink from an ink cartridge 2 and "make-up" solvent from a solvent cartridge 3. Ink and solvent are mixed in the ink tank 1 to produce printing ink which is directed from the ink tank 1 to a print head 4 by the action of a pump 4*a*. The print head 4 is arranged to appropriately direct printing ink onto a passing substrate so as to cause printing to take place.

As is known in continuous ink jet printing, the print head 4 has a gutter (not shown) to which printing ink not used in printing operations is directed. Printing ink is returned from the gutter to the ink tank 1, by means of a pump 5.

The ink tank 1 comprises a reservoir of printing ink 6 and a body of solvent saturated air 7 located above the reservoir of printing ink 6. Solvent saturated air is taken from the ink tank 1 to a condenser 8 having an input port 9 arranged to receive solvent saturated air. The condenser 8 is arranged to condense solvent from the solvent saturated air and to provide the condensed solvent through an output port 10 for return to the ink tank 1. Air separated from the solvent saturated air received through the input port 9 is output to the atmosphere through an output port 11.

The condenser 8 further comprises an input port 12 arranged to receive atmospheric air which is preferably filtered to remove any atmospheric dust and other contaminants. Such atmospheric air is obtained from the environment in which the printer is operating. Atmospheric air is pulled into the input port 12 of the condenser 8 by the action of a pump 13. The condenser 8 provides water condensed from the air received through the input port 12 through an output port 14. Air from which water has been condensed is provided through an output port 15, through which it is pulled by the action of the pump 13. Air from which water has been condensed which is output through the output port 15 is directed to the print head 4 where it is directed across the surface of the print head 4 so as to remove dust and debris from the print head, thereby acting to ensure that operation of the print head is not adversely affected by any such dust and debris.

It is highly advantageous that the air directed across the surface of print head 4 has been passed through the condenser 8 so as to remove water vapour, given that water vapour present in the vicinity of the print head 4 can result in printing ink returned from the print head 4 to the ink tank 1 by action of the pump 5 including water vapour and/or water. Such water vapour and/or water would mix with the ink within the ink tank 1 thereby generating sub-optimal printing ink which may affect operation of the print head 4.

From the preceding description it will be appreciated that the condenser 8 is arranged to condense two received fluids: a first fluid comprises solvent saturated air received through an input port 9 and a second fluid comprises atmospheric air. The condenser 8 is now described in further detail with reference to FIGS. 2 and 3.

FIG. 2 shows that the condenser 8 has a cavity 16 defined by a cylindrical housing wall 17 and a housing lid 18 which together form a housing. A coolable member 19 is received within the cavity 16. As can be best seen in FIG. 3, the coolable member 19 comprises a first portion 20 provided with two annular projections 21 and a second portion 22 having a helical surface 23.

A first annular sealing member 24 is provided at the base of the coolable member 19 between the coolable member 19 and the housing wall 17, while a second annular sealing member 25 is provided between the first and second portions of the coolable member 19 and the between the coolable member 19 and the housing wall 17.

As described with reference to FIG. 1, solvent saturated air is received through the input port 9. The received solvent saturated air is directed through a nozzle 26 into a first condenser region 27 defined between the first portion 20 of the coolable member 19 and the housing wall 17. Solvent condensed from the solvent saturated air is output through the output port 10 while air is output through the output port 11. Solvent is condensed from the solvent saturated air due to the condensing effect of the first portion 20 of the coolable member 19.

As also described with reference to FIG. 1, atmospheric air is received through an input port 12. The atmospheric air is directed to a second condenser region 28 defined between the helical surface 23 of the second portion 22 of the coolable member 19 and the housing wall 17, where the condensing effect of the coolable member 19 acts to produce water which is output through the output port 14 (which is coincident with the input port 12) and dry air which is output through the output port 15.

It can be seen that the second annular sealing member 25 provides a fluid tight seal between the first condenser region 27 and the second condenser region 28, thereby ensuring that fluids received through the input ports 9, 12 and their constituents after condensation cannot mix.

It will be appreciated that the coolable member 19 must be cooled in some way. Such cooling can be provided by the effect of an electrical pettier, or alternatively by appropriately piping refrigerated liquid.

It will be appreciated that numerous modifications to the above described embodiment may be made without departing from the scope of the invention as defined in the appended claims. For example, the two condenser regions 27, 28 could by arranged side-by-side rather than vertically stacked.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A condenser assembly for an ink jet printer comprising:

a first condenser adapted to separate first solvent vapor from a first fluid by condensation of the first solvent onto a first coolable surface; and a second condenser adapted to separate second solvent vapor from a second fluid by condensation of the second solvent onto a second coolable surface.

2. A condenser according to claim 1, further comprising:

a cooler adapted to cool both the first and the second coolable surfaces.

3. A condenser according to claim 2, wherein the cooler comprises a Peltier cooler.

4. A condenser according to claim 1, further comprising:

a first input port arranged to receive the first fluid;

first and second output ports respectively arranged to output the first solvent and first fluid from which the first solvent has been condensed;

a second input port arranged to receive the second fluid; and third and fourth output ports respectively arranged to output the second solvent and second fluid from which the second solvent has been condensed.

5. A condenser according to claim 4, wherein the second input port and the third output port are coincident.

6. A condenser according to claim 1, comprising a housing in which a coolable member is received, the coolable member providing the first and second coolable surfaces.

7. A condenser according to claim 6, wherein the housing comprises a substantially cylindrical housing wall.

8. A condenser according to claim 7, wherein the housing comprises a housing lid arranged to mate with the substantially cylindrical housing wall.

9. A condenser according to claim 6, wherein the condenser defines a first condenser region arranged to condense the first solvent from the first fluid and a second condenser region arranged to condense the second solvent from the second fluid.

10. A condenser according to claim 9, further comprising a sealing member located between the first and second condenser regions.

11. A condenser according to claim 10, wherein the sealing member comprises a fluid-tight gasket.

12. A condenser assembly according to claim 1 wherein one or more of the first and second coolable surfaces are ribbed.

13. A condenser according to claim 1, wherein the first fluid comprises air and organic solvent vapor, and the first solvent is the organic solvent.

14. A condenser according to claim 1, wherein the second fluid is atmospheric air and the second solvent is water.

15. An ink jet printer comprising a condenser according to claim 1.

16. An ink jet printer according to claim 15, wherein the ink jet printer is a continuous ink jet printer.

17. An ink jet printer according to claim 16, further comprising:

a print head; and an ink supply system arranged to provide ink to the print head and comprising an ink tank defining a chamber which is arranged to be partially occupied by a reservoir of liquid ink;

wherein the condenser is arranged to receive the first fluid from a portion of the chamber not occupied by the reservoir of liquid ink.

18. An ink jet printer according to claim 17, further comprising:

a conduit arranged to provide the first solvent to the ink tank.

19. An ink jet printer according to claim 16, wherein there is provided a pump for pumping the second fluid from which water has been condensed to the print head.

20. An ink jet printer according to claim 19, wherein the print head has a passage for receiving a flow of the second fluid after condensation of water such that the printhead is cleaned by the fluid.

* * * * *